United States Patent [19]

Kühner

[11] 3,985,243

[45] Oct. 12, 1976

[54] ROTATORY PARKING APPARATUS WITH MEANS FOR SELECTIVELY LIFTING PALLETS FIXED THERETO

[76] Inventor: Ernst Ewald Kühner, Fere Champenoise-Str. 8, D-7501 Bruchhausen, Germany

[22] Filed: May 19, 1975

[21] Appl. No.: 578,665

[30] Foreign Application Priority Data

May 22, 1974 Germany ..... 2424939

[52] U.S. Cl. ..... 214/16.1 A; 214/16.1 R

[51] Int. Cl.[2] ..... E04H 6/06

[58] Field of Search ..... 214/16.1 R, 16.1 A

[56] References Cited

UNITED STATES PATENTS

| | | | |
|---|---|---|---|
| 2,849,127 | 8/1958 | Densmore | 214/16.1 A |
| 3,352,437 | 11/1967 | Beau et al. | 214/16.1 CF |
| 3,511,389 | 5/1970 | Carter | 214/16.1 CE |

FOREIGN PATENTS OR APPLICATIONS

| | | | |
|---|---|---|---|
| 247,246 | 5/1966 | Austria | 214/16.1 A |
| 1,186,312 | 4/1970 | United Kingdom | 214/16.1 A |
| 744,968 | 2/1956 | United Kingdom | 214/16.1 A |

*Primary Examiner*—Frank E. Werner
*Assistant Examiner*—R. B. Johnson
*Attorney, Agent, or Firm*—Craig & Antonelli

[57] ABSTRACT

Apparatus for use in parking vehicles at a second level above a ground level parking surface. The apparatus has parking pallets for the vehicles which are rotatable around a central support column and each of which can be moved using lifting apparatus between a lower position corresponding to the ground level and an upper position corresponding to the second level. The lifting apparatus loosely engages the underside of a pallet and each pallet is connected to guide links so that the pallet moves into an inclined inwardly displaced position as it is lowered. In the upper position the pallets can be locked against vertical movement.

11 Claims, 5 Drawing Figures

Fig.3
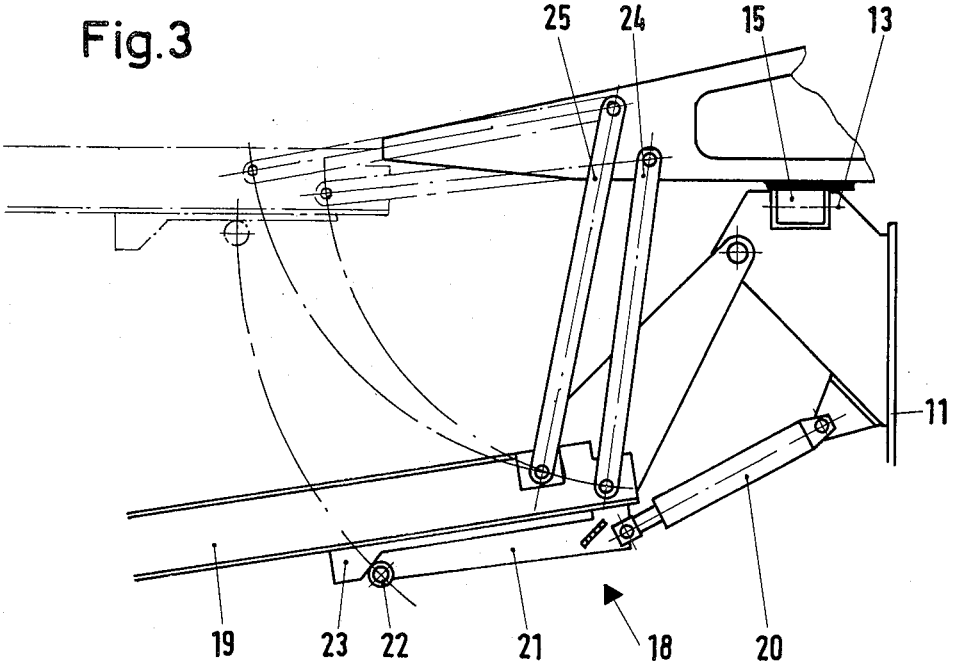
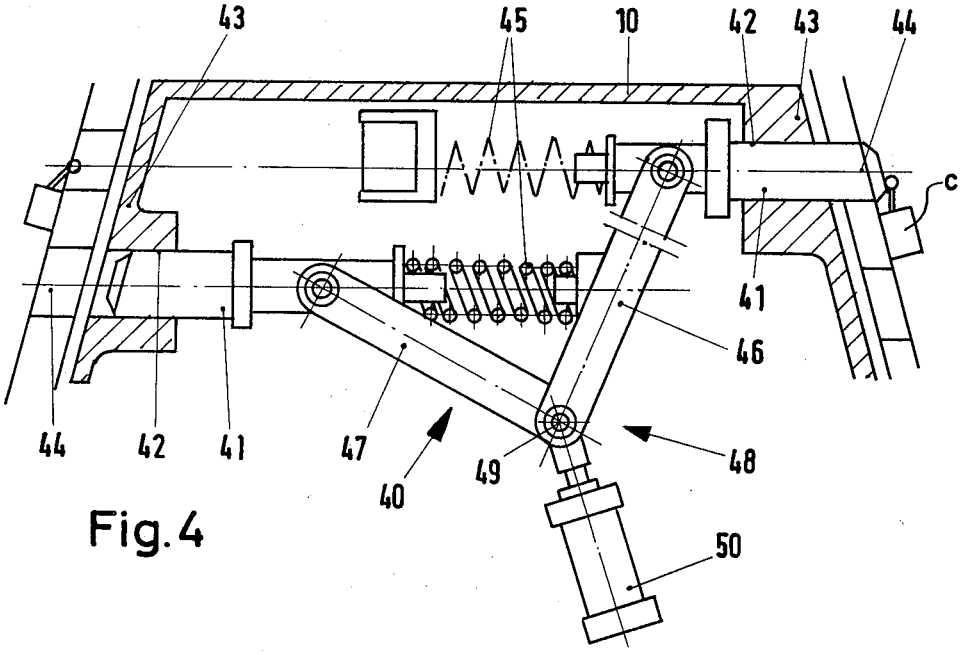
Fig.4

ROTATORY PARKING APPARATUS WITH MEANS FOR SELECTIVELY LIFTING PALLETS FIXED THERETO

This invention relates to apparatus for parking motor vehicles at a second level lying above a ground level parking surface, said apparatus being of the kind having several parking pallets arranged radially next to one another on a central column, the pallets being rotatable about the column and being movable between the second level and the ground level by means of a lifting device.

Favorable utilization of surface for parking motor vehicles is achieved with an arrangement of two parking strips arranged next to one another, the motor vehicles being parked on the two strips against one another. In order to save traffic space there is frequently provided an approach laid out for one-way traffic which runs around both parking stips and from which the vehicles are driven at an angle onto the parking strips. If on the other hand there is sufficient traffic space then the parking places may be arranged perpendicularly to the approaches and these may be laid out for two-way traffic.

Apparatus of the kind referred to above is disclosed in German Pat. No. 1,956,005 and such known apparatus is conceived as a mobile structure to be placed over a parking place of the type mentioned in the preceding paragraph in order to provide a second parking level on which almost as many vehicles can be accommodated as on the ground level parking surface located thereunder. Such apparatus is transportable, can be easily assembled at the place of erection and, for example, with changed utilization of the surface can also be easily dismantled again. Said apparatus concerns therefore not a fixed structure but an inexpensive mobile arrangement which can be brought and erected at any time at another place.

With the known apparatus the parking pallets are located at the end of long parallelogram links which are hinged on the column and which in the raised position are supported on a travelling rim by means of wheels which are mounted approximately in the middle region on the lower link which rim in its turn surrounds centrally the column. A section of the rim corresponding to a sector of a parking pallet is separate from this and is raisable and lowerable by means of a lifting apparatus so that a parking pallet rotated on this section can be lowered. In the lowered position in which either motor vehicle can be driven off or a vehicle can be driven onto the parking pallet, the pallet lies horizontally on the ground. The design of the parallelogram link, the arrangement of a separately supported rim, and the fact that the parking pallet is lowered into a horizontal position, give rise to the fact that problems may arise with the known apparatus when used with a parking place with two parking strips on which the vehicles are parked in inclined positions and for which one one-way traffic is provided, because the diameter of the apparatus is too large. In addition, the constructional expenditure involved can be considerable.

An object of the present invention is to provide an apparatus of the kind described suitable for use even with a small surface are of parking strips located thereunder which are close to one another, and with several parallel pairs of parking strips. Furthermore, an object is to reduce the constructional cost.

This problem is solved according to the invention in that the parking pallets are linked to a supporting structure which is mounted rotatably on the column via links which guide the pallets between a raised position and a lowered position, each pallet being inclined slightly and displaced inwards at the lowered position relative to the raised position, and being lockable in the raised position on the supporting structure, and in that the lifting apparatus engages loosely on the underside of the parking pallet.

The apparatus of the invention has the greatest diametrical projection when all parking pallets are raised whereas with the known apparatus this greatest projection is reached in an intermediate position during the raising and lowering respectively. In this position the parking pallets are furthermore arranged as close as possible so that they extend over the smallest possible surface. Due to the fact that the separately supported rim can be dispensed with and only one column need be provided to lead the necessary forces into the foundation, the space requirement on the ground is limited to a minimum so that, with the exception of the parking surface occurring at a loading position, little parking space is lost. The supporting structure transmits the forces into the column. The parking pallet to be loaded or unloaded needs only to be rotated to the loading place and unlocked so that it can be lowered. The lifting apparatus is stressed only during the loading and unloading procedure.

This parking apparatus is suitable in particular for use over parking surfaces in the center of a city, works sites, sports grounds or the like. It may be provided with conventional parking ticket issuing machines, locking control devices and other safety equipment.

In a preferred construction, the lifting apparatus has a lifting piston and cylinder assembly mounted on the column and connected to one corner of a triangular shaped lifting lever, a further corner of the lever having thereat a roller engaging on the underside of the parking pallet, and the third corner of the lever being linked to the column.

Due to the loose engagement on the parking pallet the lifting apparatus is under load only upon raising or lowering same whilst in the neutral position it is, for example, in a position ready for use free of load. The lifting lever forms a closed triangle with which the stresses can be taken up particularly satisfactorily.

There may be provided furthermore an electrical locking means cooperating with the mechanical locking means, which ensures that the lifting apparatus and the rotating drive for the supporting structure can only be released when all bolts are in the engaging position.

The locking means for the raised parking pallet has bolts arranged on this which in the raised position of the parking pallet automatically or in driven manner cooperate with corresponding counter-pieces on the supporting structure. The locking means, for example, may have on the supporting structure or on the parking pallet slidably arranged bolts which engage in openings on the other part. This constructionally very simple locking means may if necessary in co-operation with counter-bearings or the like take over the forces in the supporting structure.

The column preferably has a mushroom-shaped widened portion on which is provided the bearing rim for the supporting structure. Thereby the diameter of the column in the lower area is limited to the statically necessary minimum so that the ground level parking surface is only slightly reduced.

Further, on the column there may be arranged a mast passing through the supporting structure which mast carries via a framework a hood-like roof, covering the apparatus and the vehicles parked thereon. Thus, vehicles parked on the apparatus and also vehicles placed thereunder are protected against the weather, in particular in winter. Also from the architectural point of view a pleasing appearance can result.

The invention will now be described further by way of example only and with reference to the accompanying drawings in which:

FIG. 3 is an enlarged section from FIG. 2 showing the lifting apparatus;

FIG. 4 shows one embodiment of locking apparatus in plan with a parking pallet in cross-section.

Figure 1:
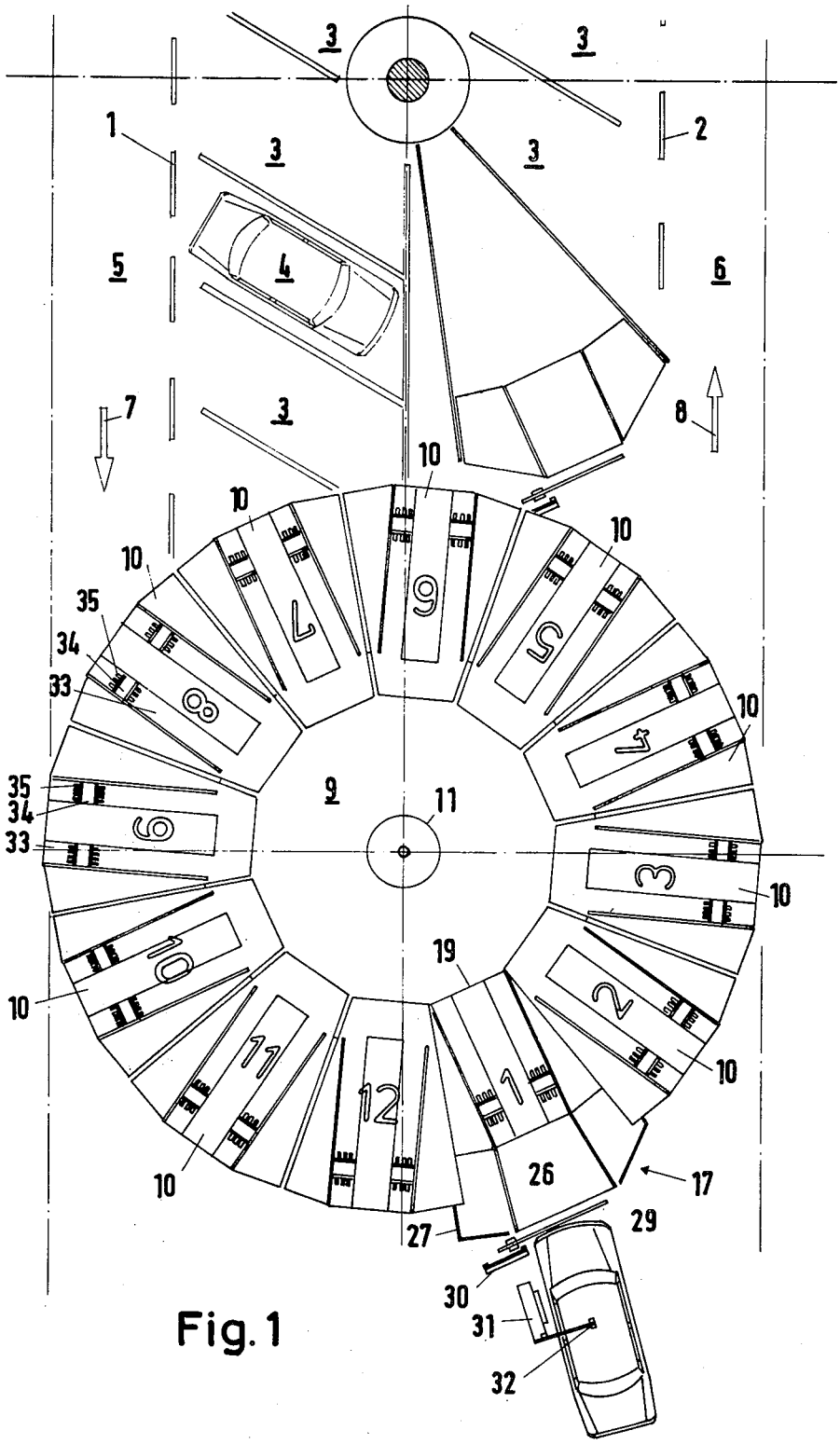
FIG. 1 is a plan of a parking surface and one form of an apparatus according to the invention erected thereon.

In FIG. 1 a parking surface with minimum space requirements is shown in section. The surface has two parallel parking strips 1,2 on which inclined parking bays 3 for motor vehicles 4 are arranged next to one another. On each parking strip 1,2 there is an approach lane or drive-in 5,6 which is provided for space-saving reasons as a one-way lane and, for example, is one-way in the direction of the arrow 7,8. On the lower end, not shown, of the two parking strips there may be provided, if necessary, a bend connecting the two approach lanes so that the lane leading to the parking surface is at the left and the exit lane at the right. On the other side of the two approach lanes 5,6 there may be arranged further parallel parking strips.

In the ground level parking strips 1,2 there is arranged an apparatus 9 with parking pallets 10 the ground clearance of which is sufficient to accommodate the usual vehicle height (car or delivery van). Each parking pallet 10 has at its narrowest place a width which corresponds at least to the minimum width of the usual vehicles. The parking pallets 10 are arranged radially around the column 11 and the circumference of the arrangement of the parking pallets 10 is selected so that on the one hand the whole ground level parking surface including the approach lanes 7,8 is covered and on the other hand the aforementioned dimension requirement for the width of the parking pallets can be maintained. There results therefore, for example, 12 parking pallets 10. According to requirements, several apparatus 9 may be erected close to one another on the parking strips 1,2. If several pairs of parking strips are arranged parallel to one another then the apparatus 9 of adjacent pairs of strips may be erected displaced in respect of one another.

The column 11 is fixed on the ground and, for example, consists of a ready-made part made of steel and concrete. A mushroom-shaped widened portion 12 formed as a steel structure is supported on the column 11 and has a bearing rim 13. Above the mushroom-shaped widened portion 12 is disposed a supporting structure 14 likewise made of steel which is rotatable by means of rollers 15 or the like on the bearing rim 13 and is driven, for example by an electric motor. The parking pallets 10 are arranged radially on the supporting structure 14 and are connected to the structure 14 in the raised position.

At a loading and unloading place 17 which is arranged similarly to the parking bays 3, at the lower level inclined to the direction of travel 8, the apparatus 9 has a lifting apparatus 18 (see FIG. 2) which is loosely engageable on a parking pallet 19 located at that place. The parking pallet 19 is identical with all other parking pallets 10. The lifting apparatus 18 consists in the embodiment shown of a lifting piston and cylinder assembly 20 which is linked to the column and is hinged to one corner of a triangular lifting lever 21. A further corner of the lifting lever 21 is linked to the mushroom-shaped widened portion 12 and at the third corner of the lever there is a roller 22 which loosely engages a guide piece 23 on the underside of the parking pallet 19. Each parking pallet 10 has such a guide piece 23.

Figure 2:
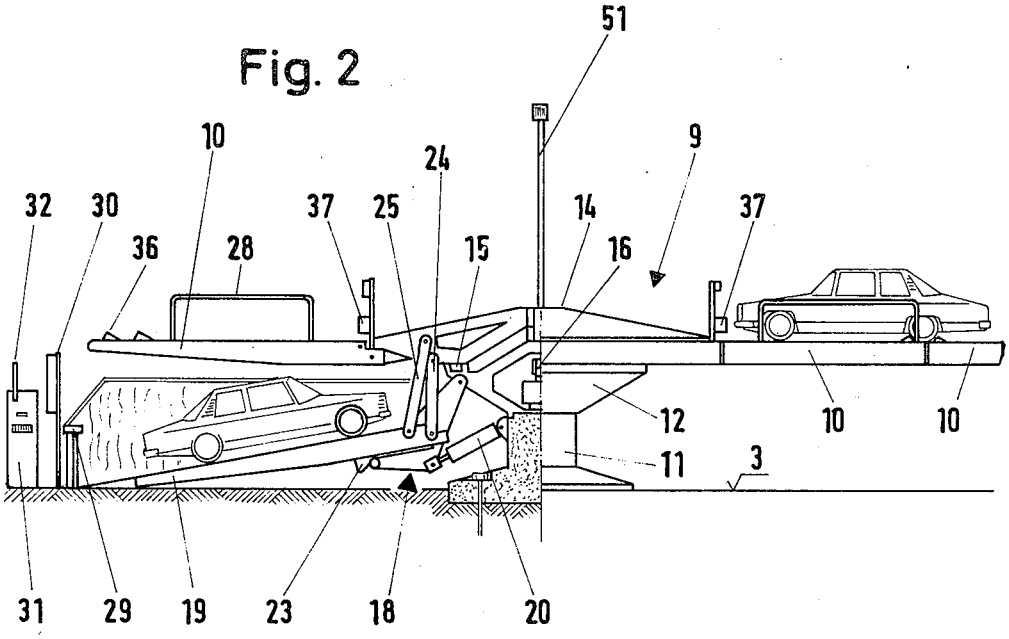
FIG. 2 is a side view partly in section of the apparatus of FIG. 1.

The parking pallets 10,19 are connected via two links 24,25 of different lengths to the supporting structure 14 and in the raised position are fixed to this structure via a locking means still to be described. The links, as can be seen in FIG. 2 engage outside the bearing rim 13 on the supporting construction and the positions of their engaging points and their length are so selected that the parking pallet 19 is slightly inclined in the lowered position. For driving on there is provided at the loading and unloading place 17 a drive-on wedge 26. Furthermore at this place a safety shut-off grill 27 is provided which limits outwardly the range of movement of the parking pallet 19. On the parking pallets 10,19 hand rails 28 may furthermore be provided for safety. In front of the loading and unloading place 17 there is placed a barrier 29 and if necessary a signal light 30. In front of the barrier 29 there is a control box 31, for example, a parking ticket machine, and a limiter 32 for the highest possible clearance profile of the vehicles capable of being received by the apparatus.

The parking pallets 10,19 may, as can be seen in FIG. 1, have parallel recessed tracks 33. At the rear end of each parking pallet 10,19 there may be provided a cross-wise channel 34 so that the driver driving onto the parking pallet will know when his vehicle is in the correct position. Behind and if necessary also arranged in front of this cross-wise channel 34 are recesses 35 by means of which blocking wedges 36 or the like (see FIG. 2) may engage from underneath by means of which rolling off of the vehicle can be prevented. On the front end the parking pallets 10,19 may have buffers 37 and a signal lamp coupled thereto which indicates the correct position of the vehicle and cooperates with an electric locking means for the lifting movement of the apparatus 18.

One embodiment of the locking means of the parking pallets is illustrated in the raised position in FIG. 4. The locking means 40 is arranged on the underside of the parking pallet 10 and consists of two locking bolts 41 which are guided in bores 42 on the side cheeks 43 of the parking pallet 10 and engage in openings 44 on the supporting structure 9. The locking bolts 41 are under the action of compression springs 45 which urge the bolts into the locking position. The ends of the bolts are connected to ends of legs 46,47 of a toggle lever 48, the knee joint 49 of which is connected to the piston of a lifting piston and cylinder assembly 50 which in its turn is supported on the parking pallet 10. In the pushed-in position of the piston the locking bolts are located in the unlocked position so that the parking pallet can be lowered. The mechanical locking means cooperates with an electric locking means for the lowering movement of the lifting apparatus 18 and if necessary with the rotary drive 16 of the supporting structure 14. The electric locking means has, for example, contact switches C arranged in the openings 44 which are closed when the locking bolt 41 is in the opening 44.

Figure 5:
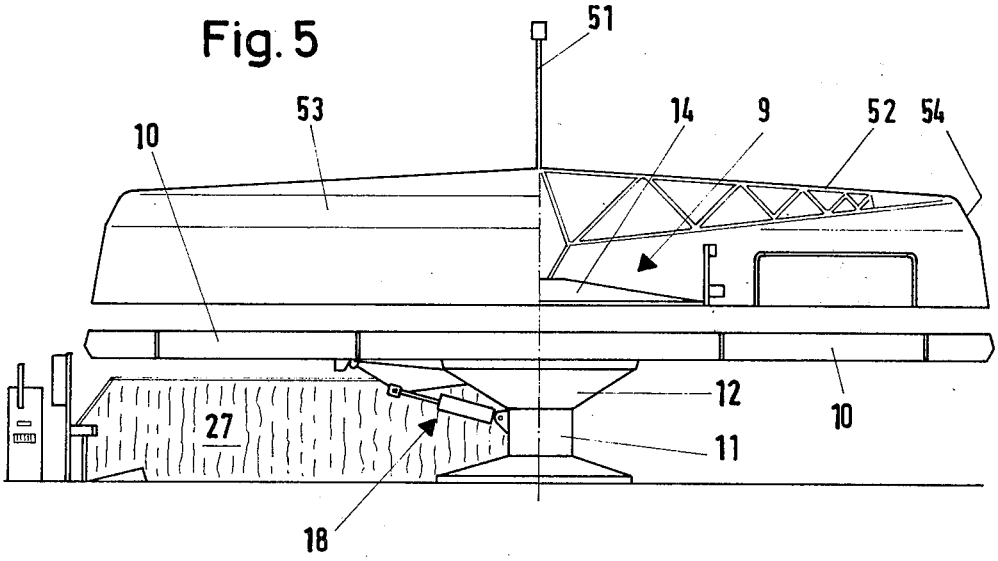
FIG. 5 shows a similar view of the complete apparatus.

In FIG. 5 one embodiment is shown which is provided with a mast 51 (as can also be seen in FIG. 2) which passes through the supporting structure 14 and is fixed on the column 11, and the mast carries a framework 52 or frameworklike arms. On the framework 52 there is fixed a hood 53 the edge 54 of which is drawn down approximately to the height of the parking pallets. The hood 53 accordingly forms a roof and at the same time a covering for the apparatus 9 which is pleasing from the town planning point of view.

The apparatus described operates as follows: At the loading and unloading place there is located an empty parking pallet 19 in the lowered position ready for use. A vehicle 51 (FIG. 1) is driven to the barrier 29 and from the parking ticket machine a parking ticket, which is coded if desired with the number of the parking pallet 19, is removed. The barrier 29 opens, the vehicle is driven onto the parking pallet and after driving over the crosswise channel 34 is blocked automatically by the wedge 36. The driver leaves the vehicle and the pallet and operates the lifting apparatus 18 either by hand or by means of a parking ticket by introducing the ticket into a corresponding code reading apparatus. The barrier 29 closes and the parking pallet 19 is raised. In the upper position the mechanical and electric locking device 40 is effective. If necessary a control may be provided which then automatically rotates the supporting structure 14 until an empty parking pallet 10 is located above the loading and unloading place 17 and unlocks and lowers this parking pallet so that there is always an empty parking pallet in position ready for use. If the driver wishes to take his vehicle he operates with his coded parking ticket or by hand the apparatus such that the parking pallet occupied by his vehicle is rotated, unlocked and lowered to the unloading place 17. After the lowering the barrier opens and the driver enters his vehicle in order to drive it off.

What I claim is:

1. Apparatus for parking motor vehicles at a second level above a ground level parking surface, comprising:

a central support column;

a supporting structure mounted on the column so as to be rotatable therearound;

a plurality of parking pallets supported on the supporting structure in side-by-side circumferentially spaced positions, the pallets extending radially relative to the column;

links interconnecting each pallet and the supporting structure whereby said pallet is movable relative to the supporting structure between a raised position and a lowered position corresponding respectively with the said second level and ground level, the pallet being slightly inclined and displaced inwards in the lowered position relative to its disposition in the raised position;

lifting apparatus selectively engageable with the underside of each pallet and operable to effect the said movement thereof between the raised and lowered positions; and locking means for locking each pallet in the said raised position thereof.

2. Apparatus according to claim 1, wherein the supporting structure has a bearing circle, and wherein the links are linked on the supporting structure outside the bearing circle of the structure.

3. Apparatus according to claim 1, wherein the lifting apparatus has at least one roller which engages on the underside of the parking pallets.

4. Apparatus according to claim 1, wherein a triangular lifting lever is provided, and wherein the lifting apparatus has a lifting piston and lifting cylinder assembly which is mounted on the column and is connected to one corner of the triangular lifting lever, a further corner of the lifting level having thereat a roller for loose engagement with the pallets, and the third corner of the lever being linked to the column.

5. Apparatus according to claim 1, wherein the locking means comprises bolts disposed on the parking pallet which in the said raised position are automatically driven into cooperation with corresponding counter pieces on the supporting structure.

6. Apparatus according to claim 5, wherein the locking means comprises bolts arranged movably on one of the supporting structure and on the parking pallet which bolts engage in openings on the respective other part.

7. Apparatus according to claim 6, wherein the pallet is provided with side cheeks, the locking bolts on the underside of the parking pallet are guided in opposite side cheeks of the pallet, spring force means for holding the locking bolts in a locked position and a piston and cylinder assembly for moving the locking bolts into an unlocked position, said piston and cylinder assembly being controlled in dependence on the position of the parking pallet.

8. Apparatus according to claim 7, wherein a toggle lever means is provided including a knee joint, and wherein the locking bolts are linked to the ends of the toggle lever means in the spread out position under the action of the spring force means, to the knee joint, said piston and cylinder assembly being connected to said knee joint.

9. Apparatus according to claim 5, wherein an electric locking means is provided for releasing the lifting apparatus for a lowering movement and a rotary drive of the support structure only when all the locking bolts of the raised parking pallet are in the engaged position.

10. Apparatus according to claim 1, wherein the column has a mushroom-shaped widened portion provided with a bearing rim for the supporting structure.

11. Apparatus according to claim 1, wherein on the column there is disposed a mast passing through the supporting structure, a framework provided on said mast, and a hood-shaped roof carried by said framework for covering the apparatus and vehicles parked thereon.

* * * * *